US005424511A

United States Patent [19]

Mas

[11] Patent Number: 5,424,511

[45] Date of Patent: Jun. 13, 1995

[54] ELECTRIC THERMAL CONVECTION COOKTOP

[76] Inventor: Newton A. Mas, 11 Hachatray St., Rehovot, Israel

[21] Appl. No.: 254,308

[22] Filed: Jun. 6, 1994

[51] Int. Cl.[6] ..... H05B 3/68

[52] U.S. Cl. ..... 219/462; 219/400; 219/460

[58] Field of Search ..... 219/400, 462, 460, 454; 126/6, 39 D, 39 L, 15 A, 15 R

[56] References Cited

U.S. PATENT DOCUMENTS

| | | | |
|---|---|---|---|
| 2,111,148 | 3/1938 | Judelson . | |
| 2,688,808 | 9/1954 | Ispen . | |
| 3,167,638 | 1/1965 | Hornaday | 219/462 |
| 3,167,639 | 1/1965 | Gaugler | 219/462 |
| 3,632,980 | 1/1972 | Harnaday | 219/462 |
| 4,499,818 | 2/1985 | Strong . | |
| 4,812,621 | 3/1989 | Brotherton et al. . | |

*Primary Examiner*—Teresa J. Walberg

*Attorney, Agent, or Firm*—Stephen M. Evans; David L. Garrison

[57] ABSTRACT

A convection cooking apparatus includes a cooking surface and a hot air generator fluidly coupled to one or more nozzles located at the cooking surface. The hot air generator is characterized as a ported chamber housing at one least electrically resistive heat source therein and fluidly coupled to a blower and at least one transfer tube. The at least one transfer tube transfers heated air from the hot air generator to the at least one nozzle. A valve is disposed intermediate the hot air generator and the nozzle to regulate the air flow there between. To maintain a constant heated air temperature, a temperature regulating means is coupled with the resistive element to control the power delivered to it. In a preferred embodiment, an external shroud encompasses the hot air generator to provide a heat shield and to direct air entering the generator around the same, thus permitting recovery of waste heat produced by the generator. An additional embodiment incorporates an oven portion which receives heated air from the hot air generator for baking or broiling items placed therein.

15 Claims, 2 Drawing Sheets

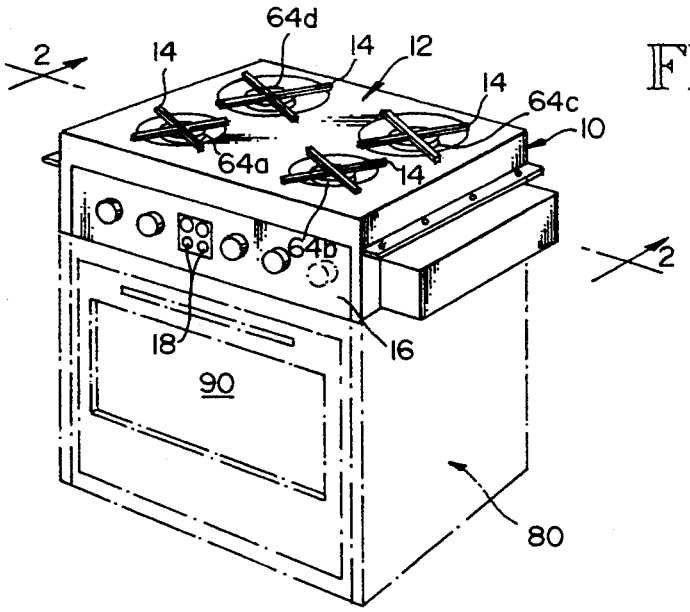
FIG. 1
FIG. 2
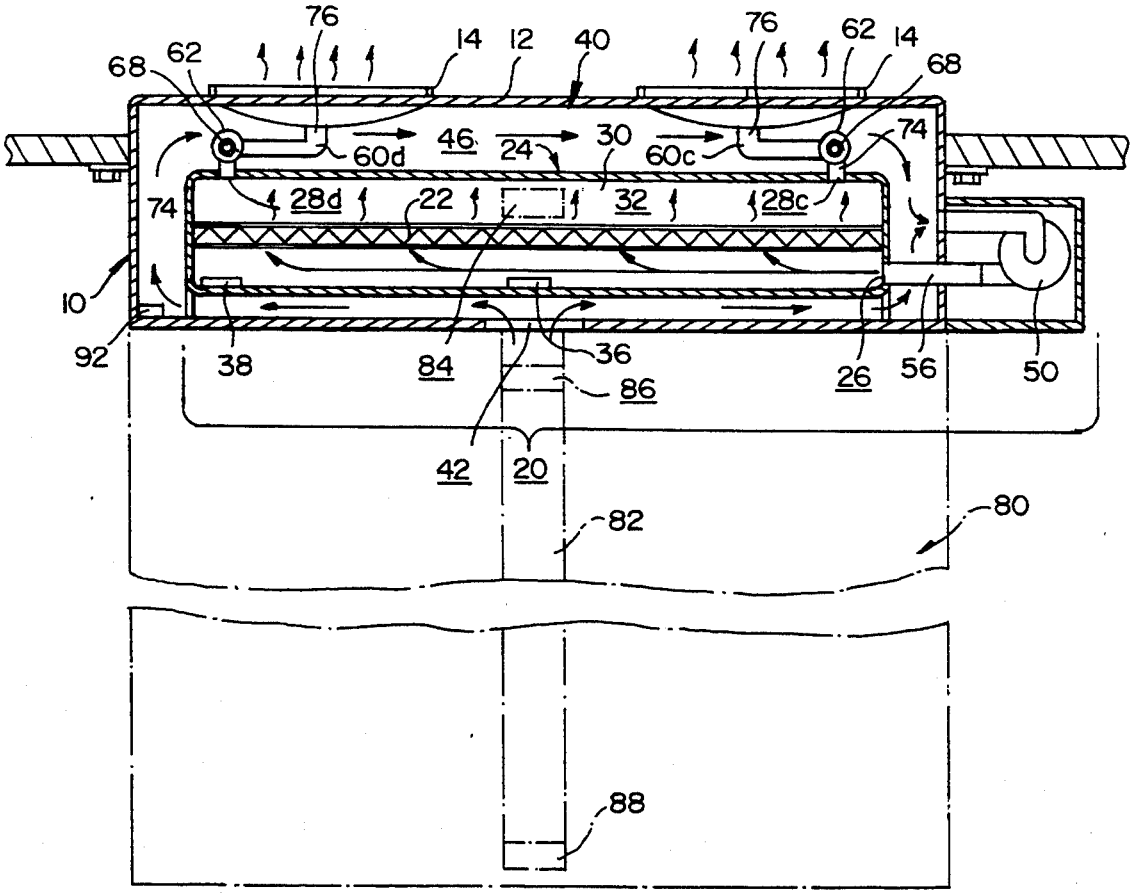

ELECTRIC THERMAL CONVECTION COOKTOP

FIELD OF THE INVENTION

The present invention is directed to the field of heating apparatus and more particularly to the field of receptacle heating by way of thermal convection.

BACKGROUND OF THE INVENTION

The earliest forms of apparatus designed to heat receptacles consisted of locating a combustible source under a heat resistant receptacle. A simple example is a receptacle supporting surface located over an open fire pit. As it became more desirable to have such apparatus located in enclosed areas such as dwellings, advances in the art generated self-contained apparatus using similar heating means such as wood fired stoves which advantageously reduced the amount of combustion byproduct associated with the heat source by porting combustion byproducts to the outside of the dwelling. To this end, the combustion chamber was made distinct from the receptacle supporting surface. Only the heat, and not the combustion gasses and particulates, were transferred to the supporting surface receptacle. Thus, heating technology changed from thermal convection to thermal conduction and radiation—the hot combustion gasses heated the supporting surface which in turn heated, by thermal conduction and radiation, the receptacle.

With the advent of readily available clean burning fuels such as methane, ethane, propane, butane, and vaporized light fuels such as kerosene and alcohol, receptacle heating technology again returned to thermal convection technology. The advantages of this form of heating included the availability of "instant heat", greater thermal transfer rates per unit of energy, and low residual heat after completion of the heating process. Because the fuels produced little undesirable combustion byproducts, there was little concern over the venting of the combustion byproducts. This method, however, was not without drawbacks which included the ever present threat of accidental explosions both locally at the apparatus and in storage units or transport lines, and potential toxicity of unburned fuels.

As the utilities infrastructure of society expanded, a new and clean source of energy was made available to the public. Electricity provided a relatively safe and convenient means of providing energy needed to heat receptacles containing liquids or food. The use of electric cooktops and ovens flourished in response. As with wood stoves, however, electric cooktops relied upon thermal conduction and radiation to heat the contained liquids and food. As is well known, the receptacle support surface comprised one or more electrically resistive elements that were subjected to electric current. Resistance to the current produced radiant heat. By placing an appropriate heat conducting receptacle on the element, which doubled as a support surface, the heat generated by the element(s) would be transferred to the receptacle and thus to the contents therein.

Nevertheless, radiant heating was subject to the same limitations as the traditional wood stove, namely slow initial heat transfers, high residual heat after cessation of the electric current, and unlike wood stoves, uneven heating characteristics. In addition, radiant heating was less efficient than thermal convection heating.

From the foregoing it becomes apparent that a cooktop having the heating characteristics of thermal convection and the convenience and safety associated with electric units is most desirable.

SUMMARY OF THE INVENTION

The present invention is characterized as a self-contained apparatus having at least one burner associated with an upper cooktop surface for heating heat resistant receptacles. The apparatus uses heated air generated from a centralized heat source disposed in a first chamber or Hot Air Generator (HAG) to create a thermal convection heat transfer cooktop. In preferred embodiments, the centralized heat source is an electrically resistive heating element. More specifically, air is delivered to the HAG by a blower or the like and is heated by exposure to the at least one heat source located therein. By using a centralized heat source for heat distribution all burner locations, inefficiencies inherent in multiple remote location heat sources and particularly resistive type heat sources are eliminated. One or more transfer tubes are fluidly coupled to the HAG at a proximal end and distribute the heated air to the upper surface of the apparatus at a distal end via a nozzle. Each nozzle terminates just below a receptacle supporting surface. The receptacle supporting surface may be integral with the nozzle, or may be associated with the cooktop surface. Each transfer tube is preferably insulated so as to decrease undesirable heat loss to the surrounding environment prior to delivery to the cooktop surface. Conventional fluid valves are located near the distal end of each tube to control the flow of heated air.

A feature of the invention is the use of an insulated shroud surrounding the HAG wherein external air is drawn in to at least one passageway defined by the exterior of the HAG and the interior surface of the shroud. In this manner, any heat emanating from the HAG during operation is generally recovered by the incoming air prior to introduction into the HAG. In a preferred embodiment, the shroud is integral with the housing of the cooktop apparatus.

Another feature of the invention and present in a preferred embodiment relates to pressure regulation in the HAG and associated transfer tube(s). By maintaining a nearly constant pressure in the HAG and transfer tube(s) during operation of the apparatus, the blower will introduce a minimum of cooler air into the HAG and thus maintain efficiencies, and the blower will not be subject to excessive back-pressure.

To control the temperature of air in the HAG, an embodiment of the invention provides for a thermal sensor located in the HAG to control, via appropriate electronic means, the current supplied to the one or more resistive elements located therein. In this manner, the temperature in the HAG remains relatively constant to ensure consistent heating characteristics based upon air flow volume. The temperature of the air may be controlled manually by the user, automatically by appropriate electronic means, or both.

The invention can also be used in conjunction with a convection type oven wherein the HAG additionally directs heated air to a semi-enclosed chamber which is designed to heat objects placed therein. The chamber is characterized as having at least one heated air inlet and at least one heated air outlet. Heated air from the HAG is introduced into the chamber and permitted to reside therein for an appropriate time sufficient to transfer heat to the interior of the chamber. Waste heated air is then permitted to escape therefrom and may be directed to the environment or wholly or partially redirected to the input of the blower associated with the HAG so that the waste heat may be recovered.

In addition to the foregoing, conventional indicator lamps are mounted to the apparatus to show to a user which burners are in operation. Preferably, two indicator lamps are associated with each burner—one lamp being located adjacent the control valve for each burner and one lamp being associated with a burner configuration panel at a location on the cooktop that permits easy visual observation.

DESCRIPTION OF THE DRAWINGS

FIG. 1 is a perspective view of the invention with an optional oven portion shown in phantom;

FIG. 2 is a cross sectional elevation of the invention of FIG. 1 showing the principal elements thereof and the air flow path with the oven portion again shown in phantom;

DETAILED DESCRIPTION OF THE INVENTION

Figure 3:
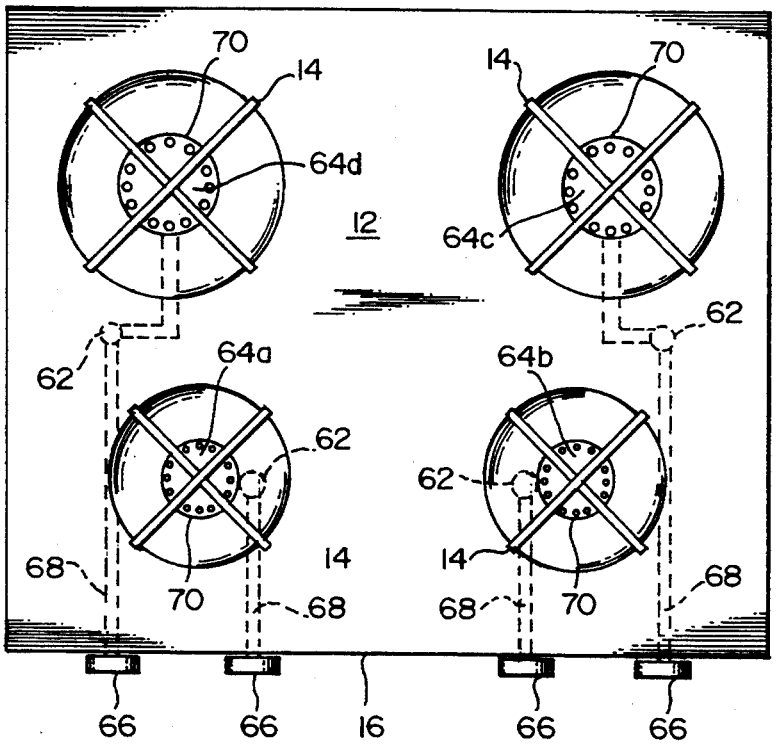
FIG. 3 is plan view of the invention.

Referring now to the several figures where like numerals indicate like parts and more particularly to FIG. 1, a perspective view of the invention is shown. While the outward appearance of the invention resembles a conventional gas type cooktop, a cross sectional elevation of a cooktop/oven embodiment of the invention as shown in FIG. 2 illustrates the unique features of the unit. The invention generally comprises cooktop unit 10 having an upper surface 12 and a plurality of support elements generally referred to as elements 14. Also shown is a Hot Air Generator (HAG) 20 defined in part by HAG enclosure 24 having at least one electrically resistive heating element 22 disposed therein. HAG enclosure 24 defines HAG chamber 32 and has at least one inlet port 26 and four outlet ports 28*a–d* (only 28*c* and 28*d* being shown for simplicity) which are fluidly coupled to four corresponding transfer tubes 60*a–d* (only 60*c* and 60*d* being shown for simplicity). HAG 20 is preferably insulated with heat resistant insulation 30 so as to retain heat generated by resistive element 22 and prevent heat from migrating therefrom.

HAG 20 is surrounded by shroud 40 which is shown as comprising the cooktop housing and which performs two important functions: First, shroud 40 acts as an additional heat barrier between the surroundings and HAG 20. Second, shroud 40, in conjunction with HAG 20 define chamber 46. Shroud 40 has at least one inlet orifice 42 which permits air to be drawn into chamber 46 and circulated therein. Blower 50, which is preferably a squirrel cage type operably linked to an electrical motor, is positioned proximate to shroud 40 and causes the air to enter chamber 46 and be expelled via tube 56 into inlet port 26 of HAG 20. The arrows shown in FIG. 2 illustrate the circulation pattern of air within chamber 46.

Each transfer tube 60 has proximal portion 74 fluidly coupled with HAG 20 and distal portion 76 fluidly coupled with a nozzle 64. As shown best in FIG. 3, nozzles 64 are characterized as a general dispersion type similar to a shower head design having a maximum sectional thickness of approximately 0.25" and a diameter dependent upon the rating of the burner. The shoulders 70 of nozzles 64 which define each orifice are preferably rounded to reduce air flow losses. Flow regulators or valves 62 are located intermediate to distal and proximal portions 74 and 76 respectively to regulate the air flow through each transfer tube 60. Valves 62 may be any valve suitable for heated air transport such as gate valves, globe valves or the like. Shafts 68 are operably linked to each valve 62 and terminate at control console 16. Attached to shafts 68 are a corresponding number of flow control knobs 66.

Figure 4:
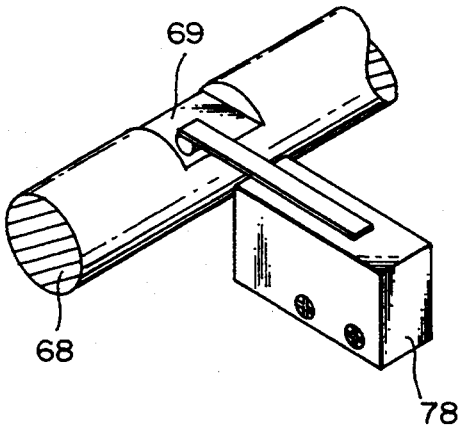
FIG. 4 is a perspective view detailing a valve shaft interacting with a lower type electrical switch to control activation of the invention.

Linked to each shaft 68 is a corresponding switch which activates resistive element 22 and blower 50 of HAG 20. Thus, rotation of any control knob 66 causes HAG 20 to operate. As shown in FIG. 4, a means to activate the switches is by way of a normally electrically open lever switch 78 riding shaft 68 wherein a flat portion 69 causes switch 78 to electrically open. When any shaft 68 is rotated so as to permit air flow between HAG 20 and any nozzle 64, the arm of a corresponding lever switch 78 rides the arcuate portion of shaft 68 and creates an electrically closed circuit. The closed circuit energizes a relay (not shown) which in turn activates HAG 20. It is to be understood that the flow regulators or valves may be replaced by electrically operated flow regulators driven by appropriate electrical or mechanical means and that valves are chosen for their simplicity and reliability. As is well known in the art, additional means for translating rotation of a shaft into an electrical signal that would activate HAG 20 are well known to those persons skilled in the art and are contemplated by the inventor. However, the present embodiment represents a simple and inexpensive means to accomplish this goal.

In order to maintain the efficiency of the apparatus, thermostat 36 is located in HAG chamber 32 as shown in FIG. 2. Thermostat 36 is preferably preset to 260° C. Once HAG chamber 32 has reached this temperature, a relay opens and de-energizes resistive element 22. When the temperature in HAG chamber 32 drops below 195° C., elements 22 are again re-energized. Also associated with HAG chamber 32 is pressure sensor 38. Pressure sensor 38 is designed to maintain a slight positive pressure differential between HAG chamber 32 compared to ambient pressure. In this manner, only a small amount of outside air is introduced into HAG chamber 32. Upon opening of any valve 62, the pressure in HAG chamber 32 will drop, causing blower 50, via pressure sensor 38, to increase the rate at which outside air is introduced into HAG chamber 32. Thus, element 22 will not be unnecessarily cooled due to excessive outside air when only minimal amounts of heated air are required, and blower 50 will not be subject to excessive back pressure. Moreover, a constant pressure will be maintained during operation at each valve 62 thus ensuring consistent air flow rates.

For safety and convenience, several indicator lamps 18 are provided as shown. Also shown in FIG. 1 and 2, cooktop unit 10 may be integrated with an oven portion 80. To do so, oven chamber 90 is fluidly coupled to HAG chamber 32 via main duct 82 when baking is required, thermostatically controlled valve (not shown but well known in the art) is activated which permits heated air to exit from HAG chamber 32 via main duct inlet 84 and enter oven chamber 90 via bake outlet 88. For broiling, a damper (not shown but well known in the art) seals off bake outlet 88 which then causes heated air to enter exclusively oven chamber 90 via broil outlet 86. Appropriate baffles (not shown but well known in the art) direct the heated air and even distribute it throughout oven chamber 90 during either operation.

For safety concerns, an auxiliary temperature sensor 92 is disposed in shroud chamber 46. Auxiliary temperature sensor 92 interrupts the power supply to the apparatus when the air temperature in shroud chamber 46 or the skin temperature of shroud 40 exceed a predetermined safe operating limit.

What is claimed:

1. A hot air convection cooktop comprising:

a) an upper, generally planar cooktop surface having at least one burner location associated therewith;

b) a hot air generator located generally under the upper surface comprising a generally enclosed housing having an upper surface, a lower surface, and a peripheral surface which together define a first chamber having at least one inlet port and at least one outlet port; at least one heat source disposed in the first chamber; and a blower having an inlet portion and an outlet portion wherein the outlet portion of the blower is fluidly coupled with the first chamber via the at least one inlet orifice;

c) at least one transfer tube fluidly coupled at a proximal end to the hot air generator via the at least one outlet orifice and coupled at a distal end to an air distribution nozzle located at the at least one burner location;

d) flow regulating means for regulating the flow of air between the first chamber and the nozzle associated with the at least one transfer tube; and e) at least one switch means for activating the hot air generator.

2. The apparatus of claim one further comprising temperature regulating means for regulating the temperature in the first chamber and wherein the heat source is at least one electrically resistive heating element.

3. The apparatus of claim 2 wherein the temperature regulating means comprises a temperature sensor having a range optimized for use in the hot air generator and disposed therein, and a power regulating device operably linked to the temperature sensor and the at least one heating element wherein the temperature sensor causes the regulating device to regulate the power supplied to the at least one heating element.

4. The apparatus of claim 1 wherein the flow regulating means comprises a flow regulating valve disposed intermediate the hot air generator and the nozzle associated with the at least one transfer tube.

5. The apparatus of claim 1 further comprising a pressure regulating means for regulating the pressure in the first chamber by controlled operation of the blower.

6. The apparatus of claim 5 wherein the pressure regulating means comprises a pressure sensor disposed internal to the first chamber and operatively linked to a regulating device to regulate the power delivered to the blower.

7. The apparatus of claim 5 wherein the pressure regulating means comprises a power sensor and regulator coupled to the blower wherein a change in power consumption of the blower due to a buildup of back pressure in the first chamber causes a reduction in power delivered to the blower by the regulator.

8. The apparatus of claim 1 further comprising an oven portion having an enclosure, the enclosure defining a first opening for depositing and removing items to be heated, an oven inlet orifice, and oven outlet orifice; and an oven conduit fluidly connecting the first chamber and terminating at the oven inlet orifice.

9. The apparatus of claim 8 further comprising a temperature responsive valve located internal to the oven conduit to regulate the flow of air from the first chamber into the oven enclosure.

10. The apparatus of claim 8 wherein the oven enclosure has a bake inlet orifice and a broil inlet orifice, wherein the bake inlet orifice is located at the lower portion of the oven enclosure and the broil orifice is located at the upper portion of the oven enclosure; the oven conduit further comprises a first secondary conduit terminating at the bake inlet orifice and a second secondary conduit terminating at the broil inlet orifice; and a damper disposed at or in the second secondary conduit for directing heated air to only the first secondary conduit.

11. The apparatus of claim 1 further comprising a shroud substantially enclosing the hot air generator wherein the exterior surface of the hot air generator and the interior surface of the shroud define a second chamber, the second chamber having at least one air ingress opening.

12. The apparatus of claim 11 wherein air entering the second chamber via the at least one ingress opening is directed around the hot air generator prior to its introduction into the inlet portion of the blower thereby causing, during operation, the preheating of the air introduced into the blower.

13. A method for constructing a convection cooktop comprising the steps of:

a) fabricating a hot air generator enclosure having an upper surface, a lower surface, and a peripheral surface wherein the enclosure defines a first chamber;

b) locating in the first chamber at least one air heating source;

c) forming an inlet port and a plurality of outlet ports in the hot air generator enclosure;

d) coupling a blower to said inlet port so as to introduce, during operation of the cooktop, air into the first chamber;

e) connecting a plurality of transfer tubes to the enclosure at a proximal end wherein one tube is associated with one outlet port, and to a corresponding plurality of nozzles at a distal end to define a plurality of air flow pathways;

f) disposing flow regulators in the air flow pathways wherein the regulators are operable by a person using the cooktop; and g) installing switch means to energize and de-energize the hot air generator upon operation of the flow regulators.

14. The method of claim 13 further comprising the step of substantially surrounding the hot air generator with a shroud to cause air entering the blower to pass around the hot air generator.

15. A hot air convection cooktop comprising:

a) an upper, generally planar cooktop surface having at least one burner location associated therewith;

b) a hot air generator located generally under the upper surface comprising a generally enclosed housing having an upper surface, a lower surface, and a peripheral surface which together define a first chamber having at least one inlet port and at least one outlet port; at least one electrically resistive heat source disposed in the first chamber; and a blower having an inlet portion and an outlet portion wherein the outlet portion of the blower is fluidly coupled with the first chamber via the at least one inlet orifice;

c) at least one transfer tube fluidly coupled at a proximal end to the hot air generator via the at least one outlet orifice and coupled at a distal end to an air distribution nozzle located at the at least one burner location;

d) flow regulating means for regulating the flow of air between the first chamber and the nozzle associated with the at least one transfer tube;

e) at least one switch means for activating the hot air generator;

f) a temperature regulating means for regulating the temperature in the first chamber comprising a temperature sensor having a range optimized for use in the hot air generator and disposed therein, and a power regulating device operably linked to the temperature sensor and the at least one heating element wherein the temperature sensor causes the regulating device to regulate the power supplied to the at least one heating element;

g) a pressure regulating means comprising a pressure sensor disposed internal to the first chamber and operatively linked to a regulating device to regulate the power delivered to the blower; and h) an oven portion having an enclosure, the enclosure defining a first opening for depositing and removing items to be heated, an oven inlet orifice, and oven outlet orifice; and an oven conduit fluidly connecting the first chamber and terminating at the oven inlet orifice.

* * * * *